US007478809B2

(12) United States Patent
Nishikawa et al.

(10) Patent No.: US 7,478,809 B2
(45) Date of Patent: Jan. 20, 2009

(54) APPARATUS FOR TRANSPORTING A SHEET INTO A READING POSITION

(75) Inventors: Hiroshi Nishikawa, Toyokawa (JP); Noritoshi Maruchi, Toyokawa (JP); Tohru Murakami, Okazaki (JP)

(73) Assignee: Minolta Company, Ltd., Osaka (JP)

( * ) Notice: Subject to any disclaimer, the term of this patent is extended or adjusted under 35 U.S.C. 154(b) by 760 days.

(21) Appl. No.: 10/623,734

(22) Filed: Jul. 22, 2003

(65) Prior Publication Data

US 2004/0201162 A1 Oct. 14, 2004

(30) Foreign Application Priority Data

Apr. 9, 2003 (JP) ..... 2003-105019

(51) Int. Cl.
*B65H 5/00* (2006.01)

(52) U.S. Cl. ..... 271/264

(58) Field of Classification Search ..... 271/167, 271/121, 264
See application file for complete search history.

(56) References Cited

U.S. PATENT DOCUMENTS 5,499,807 A * 3/1996 Nakamura et al. ..... 271/121
5,584,475 A * 12/1996 Asada et al. ..... 271/121
6,333,797 B1 12/2001 Katsuda et al.

FOREIGN PATENT DOCUMENTS

| | | |
|---|---|---|
| JP | 04-0266259 | 9/1992 |
| JP | 09-221248 | 8/1997 |
| JP | 09-226976 | 9/1997 |
| JP | 10-203682 | 8/1998 |
| JP | 11-258869 | 9/1999 |
| JP | 2001-339571 | 12/2001 |
| JP | 2003-089445 | 3/2003 |

OTHER PUBLICATIONS

Japanese Office Action mailed Jan. 24, 2006, directed to counterpart JP Application No. 2003-105019.

* cited by examiner

*Primary Examiner*—Kaitlin S Joerger
(74) *Attorney, Agent, or Firm*—Morrison & Foerster LLP

(57) ABSTRACT

An apparatus for transporting sheets into a fixed image reading position has a drive roller and a pad. The pad has a lower layer made of a flexible material and an upper layer provided on the lower layer and made of rigid material in the form of film with a kinetic friction coefficient of 0.2 or less. The is biased to the drive roller so that the upper layer contacts a peripheral surface of the drive roller to form a nipping region between the drive roller and the pad by a compressive deformation of the flexible lower layer of the pad.

7 Claims, 3 Drawing Sheets

APPARATUS FOR TRANSPORTING A SHEET INTO A READING POSITION

RELATED APPLICATION

The present application claims the benefit of a patent application No. 2003-105019, filed in Japan on Apr. 9, 2003, the entire content of which is incorporated herein by reference.

FIELD OF THE INVENTION

The present invention relates to an apparatus for transporting sheets into an image reading position, advantageously for use in an image reading device incorporated in an imaging apparatus such as copy machine and scanner.

BACKGROUND OF THE INVENTION

A sheet-through image reading device has been used for reading an image on a sheet in various imaging machines such as copy machine and scanner, which is disclosed in JP 11-59955 (A), for example. The sheet-through image reading device has an elongated transparent platen extending transversely of the sheet and a sheet transporting mechanism for transporting the sheet through a reading position on the top surface of the platen. An image-capturing device such as CCD is provided behind and adjacent to the back surface of the platen. The sheet transporting mechanism has a feed-in roller unit mounted on an upstream side of the reading position in order to feed the sheet into the reading position and a feed-out unit mounted on a downstream side of the reading position in order to feed it out of the reading station. In operation, the sheet is fed by the feed-in roller unit into the reading position where the image supported on the sheet is read by the image-capturing device. Then, the sheet is held by the feed-out roller unit so that it is pulled out of the reading position.

As described above, according to the sheet-through image reading device, since the image capturing device is fixedly mounted in the imaging apparatus, a change in the sheet transporting speed will damage a quality of a resultant image. In particular, the speed change in a full color image reading device with three CCDs corresponding to three color images (e.g., Red, Green and Blue) and positioned at different positions results in a color displacement, i.e., inaccurate superposition of three different color images, which considerably deteriorates the quality of resultant full color image.

In view of the forgoing, according to the image reading device with a feed-in roller unit made of paired rigid rollers, immediately after a tailing end of the sheet is released from a contact region of the rollers, the sheet running through the reading position is accelerated so quickly. This acceleration results in an unwanted speed variation of the sheet, which in turn considerably damages the image reading and therefore degrades a quality of the resultant image.

An improved feed-in roller unit capable of overcoming such problem is provided in JP 9-226,976 (A), which includes a rigid roller made of rigid material and a flexible roller made of flexible material. In particular, the feed-in roller unit is improved in that a periphery of the flexible roller is made of rubber having a hardness of 5-40 degrees. This results in that a wide nip is defined at the contact region of the rigid and flexible rollers, preventing the acceleration of the sheet.

However, it has been found that the feed-in roller unit with rigid and flexible rollers has another drawbacks that a feed speed of the sheet varies considerably while it is nipped between the rigid and flexible rollers.

SUMMARY OF THE INVENTION

Therefore, an object of the present invention is to provide a sheet transporting apparatus for use in an image reading device, capable of transporting the sheet through a reading position with a minimum speed vibration and with a minimum acceleration thereof.

Accordingly, an apparatus for transporting sheets into a fixed image reading position has a drive roller and an opposing pad. The pad has a rigid backup portion including a substantially flat surface, a lower layer mounted on the substantially flat surface of the backup portion and an upper layer mounted on the lower layer. Also, the upper layer is a film-like rigid material and the lower layer is a flexible material. A spring is provided to force the pad against the drive roller so that the upper layer contacts with a periphery of the drive roller to define an extended nipping region between the drive roller and the pad. In particular, the lower layer of the pad has a kinetic friction coefficient of 0.2 or less.

Another apparatus for transporting sheets into a fixed image reading position of the present invention has a drive roller, a pad and a spring. The pad has a rigid backup portion, a lower layer made of a flexible material and an upper layer provided on the lower layer and made of rigid material in the form of film with a kinetic friction coefficient of 0.2 or less. The spring biases the pad to the drive roller so that the upper layer contacts a peripheral surface of the drive roller to form a nipping region between the drive roller and the pad by a compressive deformation of the flexible lower layer of the pad.

DETAILED DESCRIPTION OF THE PREFERRED EMBODIMENTS

With reference to the drawings, a sheet transporting mechanism according to a preferred embodiment of the present invention will be described hereinafter.

Figure 1:
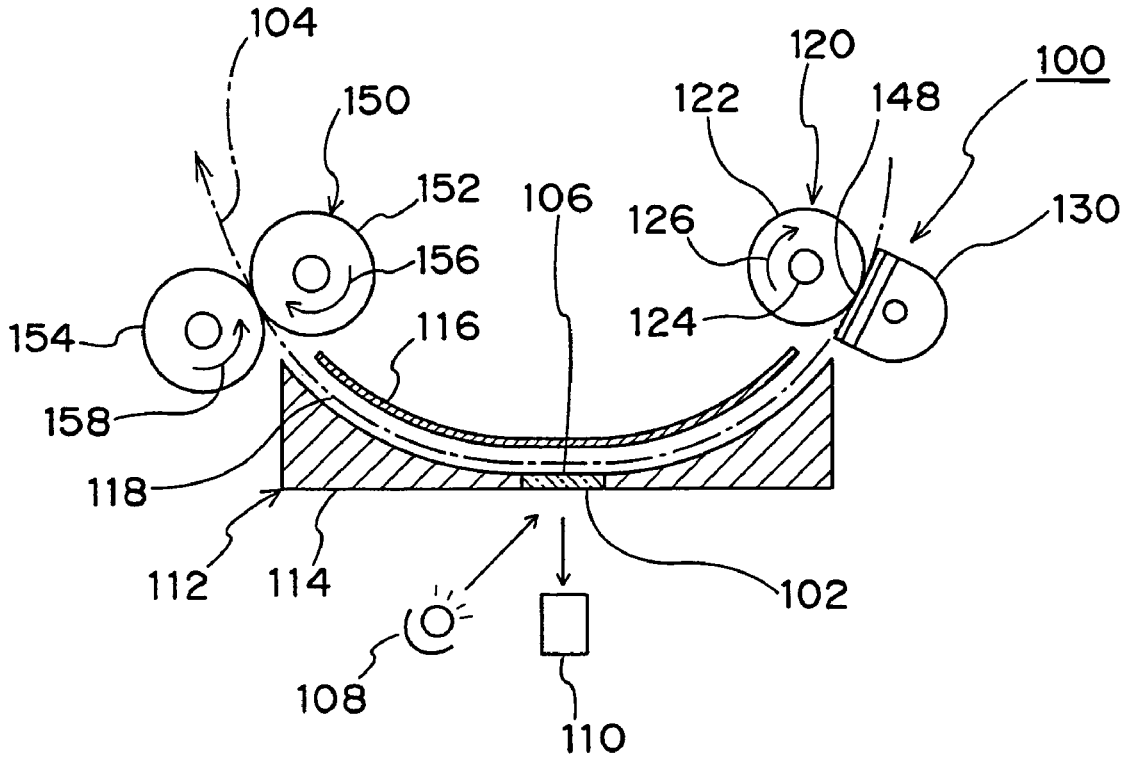
FIG. 1 is a cross-sectional view of a sheet transporting apparatus of the present invention.

Referring fist to FIG. 1, there is shown a sheet transporting mechanism, generally indicated by reference numeral 100, incorporated in an imaging machine (not shown) such as copy machine and image scanner for transporting sheets into an image reading position. The mechanism 100 has an elongated transparent glass or platen 102 securely supported by a frame of the imaging machine and extending perpendicularly to a sheet transporting direction indicated by a long and short dotted line 104. In this embodiment, a central portion of the top surface of the platen 102 is defined as a reading position 106 where each of successive portions of the image is captured in an optical manner. For this purpose, provided under the platen are a light source 108 for the illumination of the image and a light receiver 110 such as CCD. For a full color image formation, the light receiver 110 may have three CCDs for three color elements, e.g., Red, Green and Blue, respectively.

In order to attain a smooth transportation of the sheet into and out of the reading position 106, a sheet guide generally indicated by reference numeral 112 is provided. Preferably, the sheet guide 112 has a lower guide plate 114 and an upper guide plate 116 so that they define a smooth sheet passage 118 therebetween.

Figure 2:
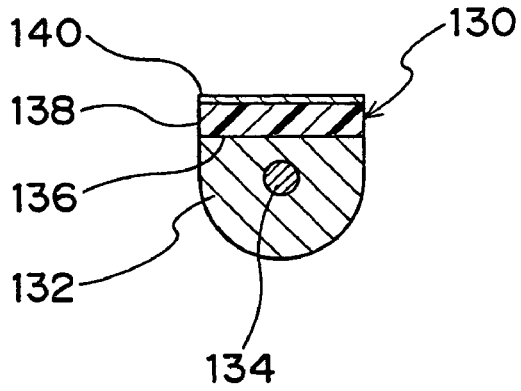
FIG. 2 is a cross-sectional view of a backup member mounted in a sheet feed-in mechanism incorporated in the apparatus shown in FIG. 1.
Figure 3:
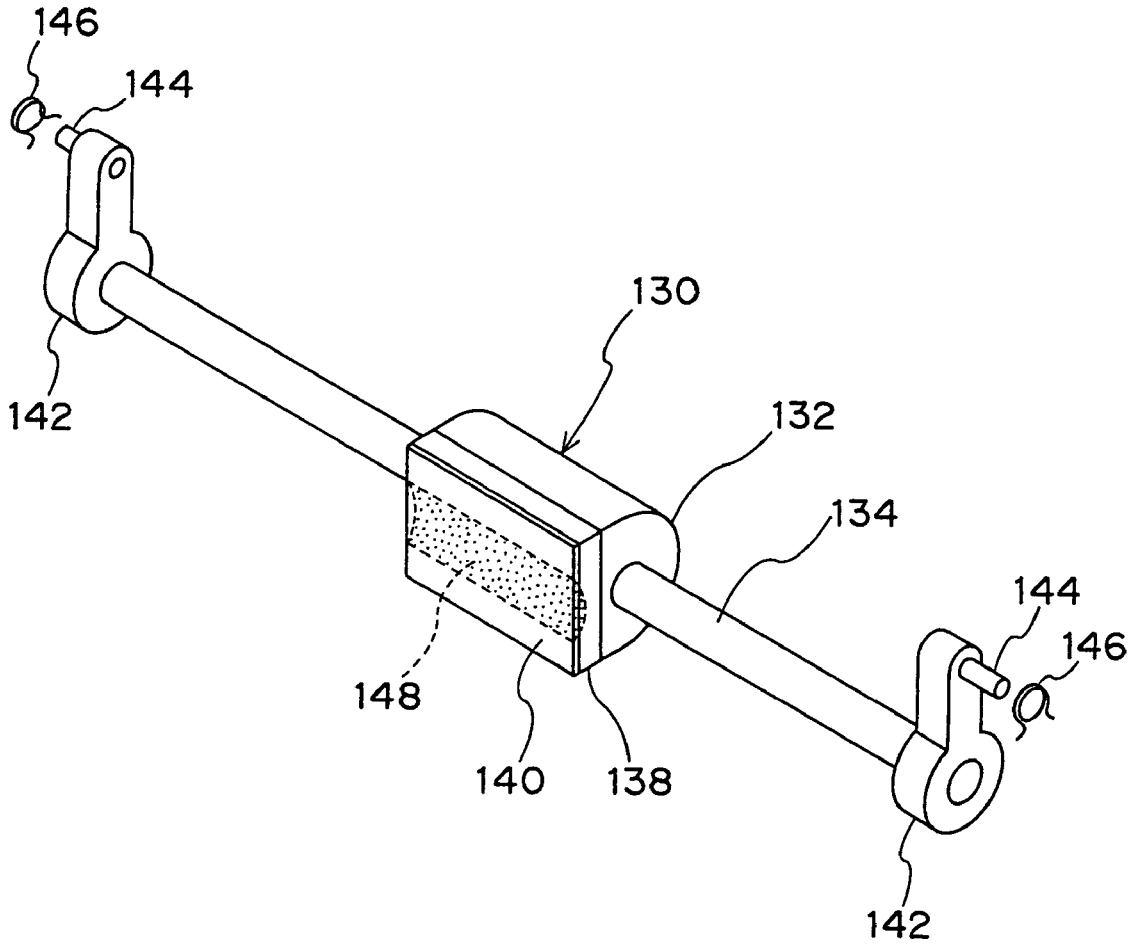
FIG. 3 is a perspective view of the backup mechanism.

A feed-in roller unit generally indicated by reference numeral 120 is provided on an upstream side of the sheet guide 112 with respect to the sheet transporting direction 104. As can be seen from the drawing, the feed-in roller unit 120 has a drive roller 122 supported on a shaft 124 for rotation in a direction indicated by reference numeral 126 and thereby drivingly connected to a motor 126 and a pad 130 forced on an outer periphery of the roller 122. A major part of the drive roller 122 is made of rigid material such as rigid urethane. On the other hand, as best shown in FIGS. 2 and 3, a major backup portion 132 of the pad 130 is made of rigid material such as rigid urethane and securely mounted on a shaft 134. The major backup portion 132 of the pad 128 has a substantially flat surface 136 opposing the roller 122 and supporting a flexible lower layer 138 and a rigid upper layer 140. The lower layer 138 is bonded on the flat surface 136 and the upper layer 140 is adhered on the lower layer 138. In this embodiment, the elastic lower layer 138 is made of an elastic material such as flexible urethane. Also, the rigid upper layer 140 is made of a rigid, low friction film material with a kinetic friction coefficient of about 0.2 or less, such as polytetrafluoroethylene. Also, the lower layer 138 and the upper layer 140 have thicknesses of about 4.5 mm and about 132 μm, respectively.

The shaft 124 of the drive roller 122 is rotatably supported by a frame of the imaging device (not shown). The shaft 134 of the pad 130, on the other hand, is supported by a pair of arms 142 which in turn are supported for rotation about respective shafts 144 provided parallel to the shaft 134. Also, a spring 146 is provided between the arm 142 and the shaft 144 so that the flexible and rigid layers 138 and 140 are biased with a pressure of about 1.6 kg, for example, onto the peripheral surface of the drive roller 122, forming an extended nipping region 148 between the roller 122 and the pad 130.

Referring back to FIG. 1, a feed-out roller unit generally indicated by reference 150 is provided on a downstream side of the sheet guide 112. Contrary to the feed-in roller unit 120 described above, the feed-out roller unit 150 has a pair of parallel rollers 152 and 154. Also, either or both of the rollers 150 and 152 are drivingly connected to a motor not shown so that, by the driving of the motor, the rollers 152 and 154 rotates in the directions indicated by reference numerals 156 and 158, respectively.

In operation of the sheet transporting mechanism 100 so constructed, a sheet (not shown) is supplied to the feed-in roller unit 120 where it is held in the nipping region 148 defined by the roller 122 and the pad 130 and then transported in the direction 104 by the rotation of the roller 122. Subsequently, the leading end of the sheet is guided into the sheet passage 118 toward the reading position 106 where each of the successive portions of the image supported on the sheet is illuminated by light from the light source 108 and then captured by the light receiver 110. The captured image is then processed for a reproduction of the image. The sheet is then guided by the sheet guide 112 to the feed-out roller unit 150 where it is nipped by the rollers 152 and 154 and then fed out of the passage 118.

Tests were made using three sheet transporting mechanisms with different feed-in roller units, i.e., A: above-described combination of rigid roller and flexible pad, the pad having a flexible lower layer on the backup member and a rigid upper layer on the flexible lower layer;

B: a combination of rigid roller and rigid roller; and

C: a combination of rigid roller and flexible pad, the pad having a flexible lower layer on the backup member but not a rigid upper layer on the flexible layer, in order to evaluate vibrations caused in the sheet during its transportation and the acceleration caused when the tailing end of the sheet is released from the feed-in roller unit.

Figure 4A:
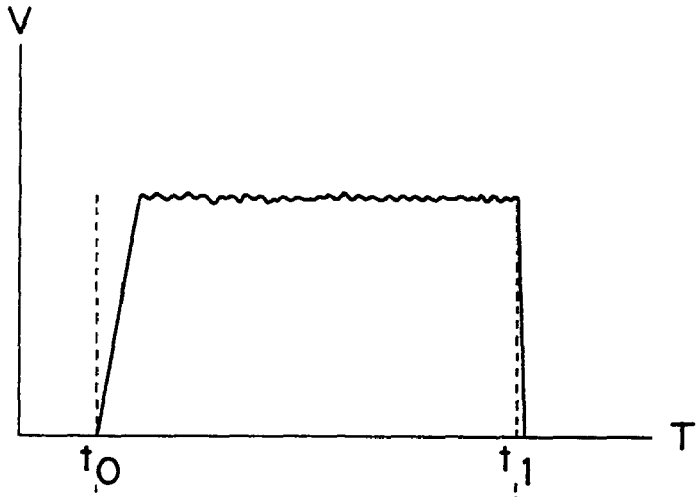
FIG. 4A is a graph showing a time-velocity relationship of the sheet transported by an apparatus with a feed-in roller unit of paired rigid rollers.
Figure 4B:
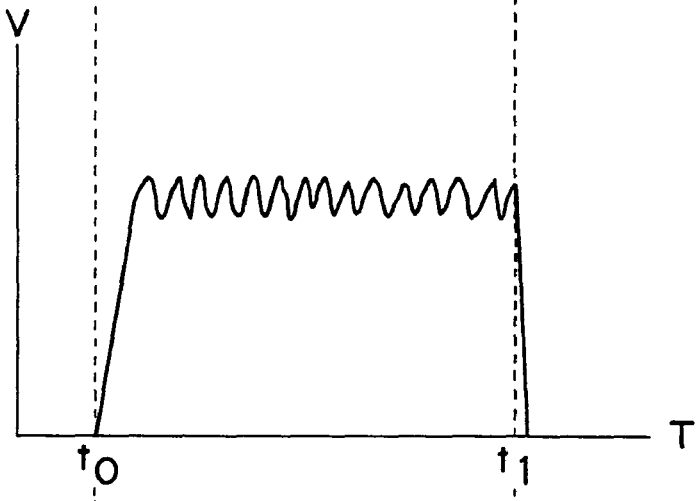
FIG. 4B is also a graph showing a time-velocity relationship of the sheet transported by another apparatus with a feed-in roller unit of a rigid roller and a flexible pad without any upper rigid layer or film.
Figure 4C:
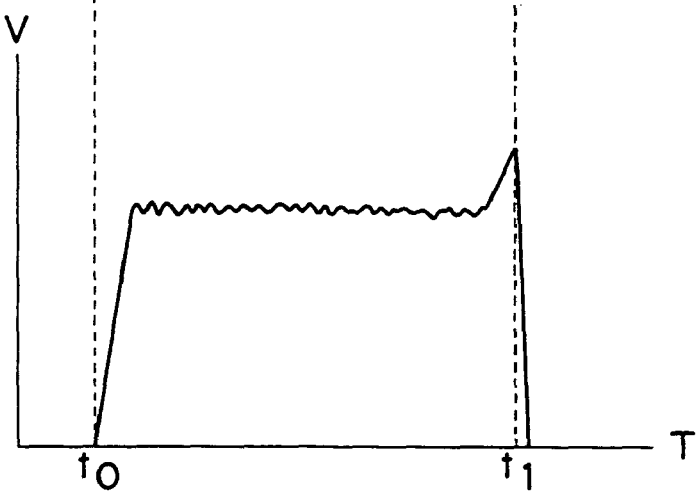
FIG. 4C is a graph showing a time versus velocity relationship of the sheet transported by the apparatus of the present invention with a rigid roller and a flexible pad with an upper rigid layer or film.

FIGS. 4A-4C show test results for the feed-in roller units A, B and C, respectively. It should be noted that each graph shows a velocity (y-axis) versus time (x-axis) relationship. Also, in each graph, a time t0 represents a timing when the sheet transportation was started and a time t1 represents another timing when the tailing end of the sheet was released from the nipping region. As can be seen from the drawings, the unit C with the rigid/rigid rollers caused a quick acceleration of the sheet when it is released from the nipping region of the rollers. Also, in case of unit B free of top rigid film layer, no acceleration was generated, however; relatively large speed vibrations were generated during its transportation. Contrary to those units, neither acceleration or large vibrations were generated in unit A of the present invention.

Also, as a result of tests using various materials for the upper layer of the pad, it was found that the material of the upper layer is preferably selected from those with a kinetic friction coefficient of equal to or less than 0.2. This reduces a friction generated between the rigid roller and the upper layer of the pad, which stabilizes the transportation of the sheet for a long term. For this reason, the above-described polytetrafluoroethylene is preferably used for the upper layer of the pad. More preferably, an ultra high molecular weight polyethylene, having a kinetic friction coefficient of about 0.15, commercially available from Saxin Corporation, 4-2-1 Sekitsu, Otsu-shi, Shiga, Japan, under the trade name of NEW LIGHT is used. Alternatively, other materials such as a film made of glass cloth impregnated with polytetrafluoroethylene, commercially available from Yodogawa Hu-Tech, Inc., 2-4-8 Esaka, Suita-shi, Osaka, Japan, under the trade name of Tigerflowfabric, and a porous sheet made of ultra-high-molecular-weight polyethylene resin (UHMWPE), commercially available from Nitto Denko Corporation, 1-1-2 Shimohozumi, Ibaraki-shi, Osaka, Japan, under the trade name of SUNMAP are used.

Advantageously the flexible lower layer is made of material with a minimum compressive residual strain of about 10% or less, when tested according to Japanese Industrial Standard (JIS) K-6401. In particular, a high density, microcellular urethane foam material, commercially available under the trade name of PORON from Rogers Corporation, 245 Woodstock Road, Woodstock, Conn. 06281-1815, U.S.A, is preferably used.

Further, the upper layer of the pad is preferably made of electrically conductive material. In this instance, the upper layer is electrically connected to the ground so that an electrostatic charge generated by the contact with the sheet is discharged. For this purpose, preferably the lower layer, the major part and the shaft of the pad are also made of electrically conductive material.

In view of the foregoing, according to the present invention, the combination of the rigid roller and the flexible pad covered by the upper layer reduced friction coefficient allows the sheet to be transported through the reading position in a stable manner with minimum vibrations of the sheet and without any acceleration of the sheet when its tailing end is released from the feed-in roller unit. A possible offset of the image from the sheet to the upper layer of the pad is minimized due to the reduced friction coefficient of the upper layer of the pad.

What is claimed is:

1. An apparatus for transporting sheets into a fixed image reading position, comprising:

a drive roller; and a pad comprising a lower layer made of a flexible material and an upper layer disposed on the lower layer and made of a rigid material with a kinetic friction coefficient of 0.2 or less, the pad being biased to the drive roller so that only the upper layer contacts a peripheral surface of the drive roller to form a nipping region between the drive roller and the pad by a compressive deformation of the flexible lower layer of the pad, wherein the pad is configured within the apparatus so that sheets traveling between the driver roller and the pad do not come in contact with any flexible material that has a kinetic friction coefficient higher than the rigid material of the upper layer.

2. The apparatus of claim 1, wherein the lower layer of the pad has a compressive residual strain of 10% or less.

3. The apparatus of claim 1, wherein the upper layer of the pad is made of an electrically conductive material.

4. The apparatus of claim 3, wherein the lower layer of the pad is made of an electrically conductive material.

5. The apparatus of claim 4, configured so that an electrostatic charge generated by a contact between the upper layer and a sheet is discharged through the lower layer.

6. The apparatus of claim 1, wherein the pad is biased toward the drive roller by a spring.

7. An apparatus for transporting sheets into a fixed image reading position, comprising:

a drive roller;

a rigid backup portion comprising a top surface facing the driver roller;

a lower layer made of a flexible material and covering the entire top surface of the rigid backup portion;

an upper layer disposed on the lower layer and made of a rigid material with a kinetic friction coefficient of 0.2 or less; and a spring which biases the rigid backup portion to the drive roller so that only the upper layer contacts a peripheral surface of the drive roller to form a nipping region between the drive roller and the upper layer by a compressive deformation of the flexible lower layer of the pad.

* * * * *

UNITED STATES PATENT AND TRADEMARK OFFICE

CERTIFICATE OF CORRECTION

PATENT NO. : 7,478,809 B2
APPLICATION NO. : 10/623,734
DATED : January 20, 2009
INVENTOR(S) : Hiroshi Nishikawa et al.

It is certified that error appears in the above-identified patent and that said Letters Patent is hereby corrected as shown below:

On the Title Page, Item (73) Assignee:

Please replace "MINOLTA COMPANY LTD." with --MINOLTA CO., LTD.--.

Signed and Sealed this

Third Day of March, 2009

JOHN DOLL
*Acting Director of the United States Patent and Trademark Office*